US005515954A

United States Patent [19]

Nordstrom

[11] Patent Number: 5,515,954

[45] Date of Patent: May 14, 1996

[54] MOBILE CARRY-ON SUITCASE

[75] Inventor: Mark Nordstrom, Brentwood, Tenn.

[73] Assignee: Lenox, Incorporated, Lawrenceville, N.J.

[21] Appl. No.: 344,727

[22] Filed: Nov. 23, 1994

Related U.S. Application Data

[63] Continuation of Ser. No. 160,055, Nov. 30, 1993, Pat. No. 5,431,263.

[51] Int. Cl.[6] ..... A45C 5/14

[52] U.S. Cl. ..... 190/18 A; 190/115

[58] Field of Search ..... 190/18 A, 115, 190/109, 110, 111; 16/115

[56] References Cited

U.S. PATENT DOCUMENTS

| | | | |
|---|---|---|---|
| 2,176,792 | 10/1939 | Currie . | |
| 2,418,589 | 4/1947 | Lifton . | |
| 2,581,417 | 1/1952 | Jones . | |
| 2,839,167 | 6/1958 | Smith . | |
| 3,163,268 | 12/1964 | Leavell . | |
| 3,257,120 | 6/1966 | Browning | 280/47.17 |
| 3,606,372 | 5/1969 | Browning | 280/47.17 |
| 3,805,929 | 4/1974 | Kuwayama | 190/18 A |
| 3,917,038 | 11/1975 | Foge et al. | 190/18 A |
| 4,087,102 | 5/1978 | Sprague . | |
| 4,206,835 | 6/1980 | Shapiro . | |
| 4,256,320 | 3/1981 | Hager . | |
| 4,261,447 | 4/1981 | Arias et al. | 190/18 A |
| 4,299,313 | 11/1981 | Null | 190/18 A |
| 4,420,068 | 12/1983 | Gerch | 190/102 |
| 4,436,189 | 3/1984 | Baum | 190/108 |
| 4,524,482 | 6/1985 | Mueller | 190/18 A X |
| 4,550,813 | 11/1985 | Browning | 190/18 A |
| 4,610,333 | 9/1986 | Seynhaeve | 190/18 A |
| 4,693,345 | 9/1987 | Mittlemann | 190/18 A X |
| 4,759,431 | 7/1988 | King et al. | 190/18 A |
| 4,792,025 | 12/1988 | Thomas | 190/18 A |
| 4,854,431 | 8/1989 | Pulichino, Jr. et al. | 190/108 |
| 4,953,674 | 9/1990 | Landes | 190/108 |
| 4,995,487 | 2/1991 | Plath | 190/18 A |
| 5,031,766 | 7/1991 | Cohen | 206/289 |
| 5,048,649 | 9/1991 | Carpenter et al. | 190/18 A |
| 5,075,925 | 12/1991 | Maloney | 190/115 X |
| 5,115,895 | 5/1992 | Myers | 190/18 A |
| 5,240,106 | 8/1993 | Plath | 206/316.2 |
| 5,253,739 | 10/1993 | King | 190/18 A |

FOREIGN PATENT DOCUMENTS

| | | | |
|---|---|---|---|
| 5879 | 12/1979 | European Pat. Off. | 190/18 A |
| 2409720 | 6/1979 | France . | |
| 2538229 | 6/1984 | France . | |
| 2168035 | 6/1986 | United Kingdom . | |

*Primary Examiner*—Allan N. Shoap
*Assistant Examiner*—Christopher J. McDonald
*Attorney, Agent, or Firm*—Eckert Seamans Cherin & Mellott

[57] ABSTRACT

A suitcase has an extendable handle movable between extended and retracted positions, and wheels whereby the suitcase is tilted for transport on the wheels and manipulated via the handle. The case is generally rectilinear in shape, with the top, bottom, front, rear and side panels occupying orthogonal planes. The extensible handle can have a U-shape with spaced elongated arms extending from a central gripping portion and slidable in sockets in the case. The handle and wheels are mounted at the front and rear edges of the bottom wall, and two compartments are accessible by slide fasteners on the top and around an internal partition. The bottom panel is connected to the front and rear panels by front and rear inclined panel sections. The handle sockets are mounted on one inclined panel, permitting the handle to extend and retract. Wheel-carrying brackets are mounted on the other inclined panel, the wheel axes being fixed. The inclined panels are arranged such that the gripping part of the handle, when retracted, and the outer perimeters of the wheels, are spaced inwardly from the intersections of the planes of the bottom of the case and the planes of the front and rear panels. Thus the retracted handle and the fixed-axis wheels reside inside the orthogonal rectilinear shape and do not form protrusions to snag upon or engage surfaces over which the case is passed.

11 Claims, 5 Drawing Sheets

MOBILE CARRY-ON SUITCASE

This is a continuation of application Ser. No. 08/160,055, filed Nov. 30, 1993, U.S. Pat. No. 5,431,263.

BACKGROUND OF THE INVENTION

1. Field of the Invention

The invention relates to the field of suitcases, baggage items and the like, and in particular concerns a case of the type having wheels at an edge and a handle that is extendible from the case, for drawing the case over a ground surface in the manner one might pull a handtruck.

2. Prior Art

A variety of designs exist for suitcases, including those with wheels for rolling transport across the ground or other planar support surface, and those having handles that extend to cooperate with the wheels by permitting a user to pull or push the case along on the wheels. Such suitcases are generally rectilinear in shape, both as to their outer contour and the internal container volume enclosed. Two spaced coaxial wheels are mounted externally at the corner of a lower edge of the case, i.e., between a bottom and side at a corner remote from the handle. The handle can have one or more rods that slides or telescopes from a receptacle in the case such that the handle can be retracted into the case for storage or extended from the case for use. The handle extends from the case at a different corner edge than the wheels, and typically along the same side of the case as the wheels. In the extended position, the handle provides a graspable part imparting control of the case and some leverage, permitting the user to tilt the case up onto the wheels and to steer or negotiate the case across the ground or other planar support surface, while pulling or pushing the case along on the wheels. The handle is also helpful in passing the case over obstructions such as stairs.

The handle is stored away by pushing the handle rod or rods back into their receptacles. When fully retracted, the outermost portion of the handle protrudes from the outline of the case only enough to be grasped for pulling the handle back outwardly into the extended position, e.g., protruding by the width of the graspable pan of the handle. While retracted, the handle is less likely to be damaged from rough handling than when extended, and the case is made compact, for example, for storage in an overhead compartment or under the seat of an airplane or the like.

Known designs for mobile suitcases having wheels and extensible handles, as described, have an inherent disadvantage. It is necessary for the wheels to protrude outwardly from the outer contour of the case at the lower edge corner. Protrusion of the wheels is required so that when the case is tilted up onto this corner, the wheels, rather than the corner of the case, engage the ground as the case is pulled or pushed along. However, the protruding wheels are vulnerable to damage when handling the case, and tend to catch against other adjacent cases, against the surfaces of storage compartments and the like. The handle, even when retracted, likewise protrudes from the rectangular outer contour of the case to enable the handle to be grasped when in the retracted position. The protruding part of the handle and the wheels are both prone to suffer damage in handling, because they extend beyond the body of the case. The protruding handle and wheels also tend to catch on adjacent cases or on surfaces where the case is placed, making it more difficult to stow the case or to extract it from a storage compartment than a case with a regular rectilinear outer contour.

It is possible to provide wheel or handle mountings that are received fully into a case in a retracted position. This protects the wheels and the handle, and presents a smooth outer contour for the case. For example, the handle can retract into a slot rather than rest outside the corner. A mechanism can be provided that advances the wheels from a receptacle into a protruding position only when the case is to be rolled about manually. However, a handle in a slot is more difficult to grasp for pulling the handle into the extended position. The slot uses a portion of the volume of the container, particularly where the handle rod receiving structures are not immediately adjacent the container wall. A mechanism for deploying wheels also takes up space in the container, and may be complex and expensive. Moreover, movable mountings for wheels are less durable and stable than fixed mountings.

It would be advantageous to provide a durable and inexpensive fixed mounting for the wheels and/or handle of a case as described, which does not unduly disturb the exterior and internal contours of the container, or interfere with access or use of the wheels and handle.

SUMMARY OF THE INVENTION

It is an object of the invention to provide a mobile suitcase having wheels and an extendable handle which are protected from the kinds of abuse that come with rough handling, yet protrude to enable access to the handle and unencumbered operation of the wheels.

It is another object of the invention to provide, in a mobile suitcase having a rectilinear outer contour and enclosed internal volume, particularly as sized for carry-on luggage, protection for fixedly mounted wheels and an accessible handle.

It is a further object of the invention to provide, in a suitcase having a rectilinear shape and two independently accessible internal compartments, protective features for an extensible handle and wheels.

These and other objects are accomplished by a suitcase having a handle and at least one handle rod that is movable between extended and retracted positions. Preferably the handle is U-shaped, with a gripping portion between spaced parallel elongated rods or arms, slidably received in receptacles immediately along the inner wall of the case. The case comprises a generally rectilinear container, with outer front and rear walls spaced by a reinforced side wall and an opposite side wall. An outer bottom and top wall enclose the front, rear and side walls to define a closed volume. The top wall is connected to the reinforced side wall by a flexible hinge portion, and has a zipper or similar sliding fastener element along its other three edges. The top wall thus permits access to the interior of the case and includes the zipper for securing the top panel closed.

The bottom wall extends in the front to rear direction between spaced front and rear edges. The front and rear walls meet at a bottom edge. A front incline panel is joined to and extends between the front edge of the bottom wall and the bottom edge of the front wall. A pair of arm-receiving sockets are disposed at spaced positions on the front inclined panel for receiving the handle arms or rods. The sockets define openings through which the elongated handle arms reciprocate reversibly in the front to rear direction between the extended and retracted positions.

A rear inclined panel is joined to and extends between the rear edge of the bottom wall and the bottom edge of the rear wall. A pair of wheel-carrying brackets are mounted to the rear-inclined panel at laterally spaced positions. Each bracket has a pair of projecting flanges defining a wheel mounting, supporting a pivot pin for rotatably mounting a wheel, coaxial with the other wheel along an axis parallel to the corner edge of the case.

The front incline panel is arranged and sized such that the gripping portion of the handle, while the handle is in the retracted position, protrudes, at most, up to a pair of intersecting planes respectively defined by the bottom and front walls of the suitcase. Thus the graspable portion of the handle does not protrude beyond a rectilinear outer contour corresponding to the outer surfaces of the case. Similarly, the ground-engaging perimeters of the wheels protrude, at most, up to a pair of intersecting planes respectively defined by the bottom and rear walls of the case. Thus, the rear and bottom walls cooperatively act to protect the wheels, and the front and bottom walls cooperatively act to protect the handle, when the case is handled by sliding it over the ground, over the surfaces of compartments, or along other cases with which the case may be stacked.

Although the handle and wheels are thereby protected along the incline surfaces, both remain accessible as needed for their functions. The grasping part of the handle is readily accessible on the surface of the incline. The wheel surfaces are presented when the case is tilted and rolled along. More particularly, the wheels protrude to engage a planar support surface while the bottom and rear walls are substantially inclined relative to that planar support surface. The handle and the wheels are disposed at opposite ends of the same wall, whereby tilting the case via the handle brings the incline surface adjacent the wheels more nearly parallel to the support surface over which the case is rolled, thereby deploying the wheels inherently, due to their protrusion from the incline surface. Nevertheless, the wheels are protected from surfaces passing over the case along the walls, because the wheels project, at most, to the extension of the planes of the walls.

The case preferably includes a partition that is disposed between the top and bottom walls, parallel to the top and bottom walls. The partition extends between the front, rear and side walls. The top wall and partition can define a relatively smaller article compartment, while the bottom wall and partition define a relatively larger article compartment.

The partition preferably is connected to the reinforced side wall by the same flexible hinge portion that mounts the top wall to the case (apart from the zipper). The partition can have a sliding fastener along its free edges, for attachment to the case in a manner similar to the attachment of the top wall, i.e., with front, rear and opposite side walls of the partition attached relative to the side walls along free edges via a sliding fastener element. Thus, the partition is usable in the manner of a flexible flap providing access to the larger article compartment, the sliding fastener releasably securing the partition closed.

The larger article compartment can be packed with incidentals and clothing generally. The smaller article compartment is sized for removably receiving full length garments like suits and dresses, preferably in a full length garment bag twice folded upon itself and inserted neatly into the smaller compartment.

The suitcase according to the invention is preferably about 22×16×9 inches in overall dimension, which is apt for carry-on use in that the case fits under seats and into overhead receptacles in airplanes, buses, trains and the like. However, the invention is applicable to luggage of varying sizes.

The invention is advantageously applied to soft-sided luggage, particularly because the wheel and handle mountings protect the flexible material of the case, while these mountings and the internal structures associated with the handle and the partition lend support against collapse. Protective sliding strips extending between the handle sockets and the wheel brackets can further support and protect the case, and feet or bumpers can be included as well, for example opposed to portions of the wheel bracket that are raised from the wall of the case as feet. The invention is also applicable to hard-sided luggage as well.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
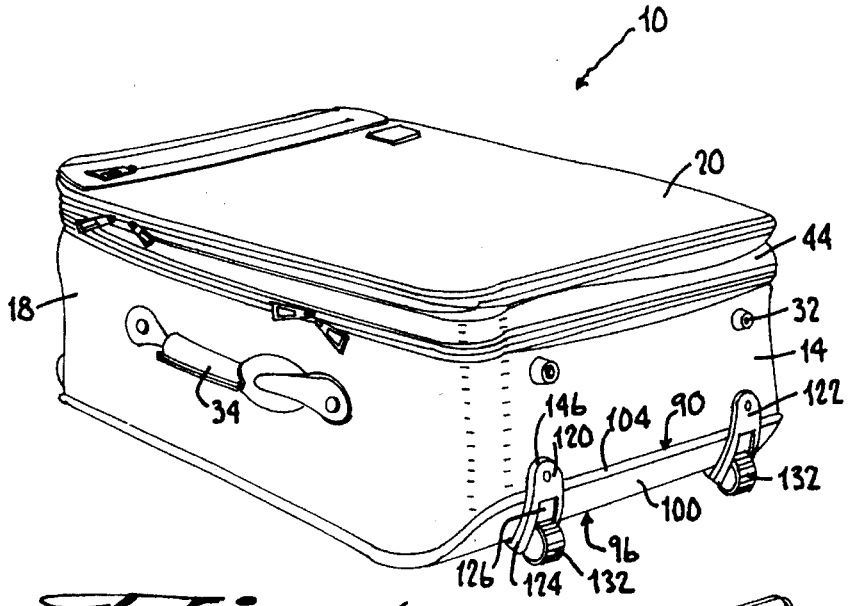
FIG. 1 is a perspective view of a suitcase according to the present invention, shown with the top wall facing upwardly.
Figure 2:
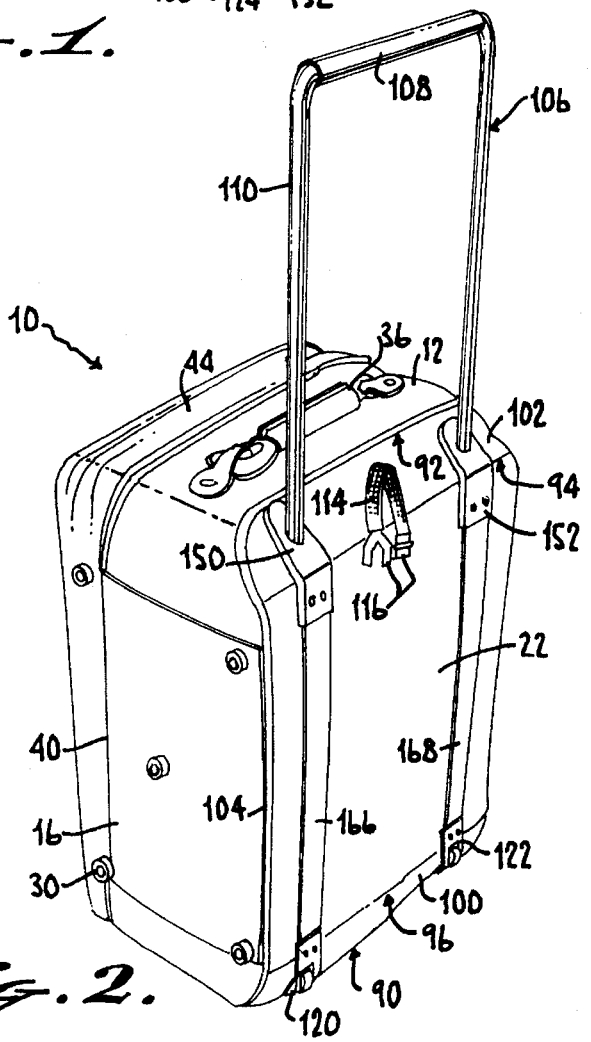
FIG. 2 is a perspective view of the suitcase of FIG. 1, shown standing on end and with the extendable handle disposed in its extended position.

As shown in FIGS. 1 and 2, a suitcase 10 according to the invention has a front or handle-end wall 12, a rear or wheel-end wall 14, a reinforced side wall 16 and an opposite side wall 18. The case has a top wall 20 and bottom wall 22 that enclose the front 12, rear 14 and side walls 16 and 18. The respective walls define a generally rectangular container, both in external shape and in the internal enclosed volume.

The case according to the present invention is particularly apt as an article of carry-on luggage. For this purpose, the case can be about 22×16×9 inches in overall dimension (i.e., 56×41×23 cm). The invention is also fully applicable to luggage of other sizes, especially larger sizes. The case advantageously can be an article of soft-sided luggage, particularly due to the structural features discussed below, but the invention applies equally to hard-sided luggage.

Figure 8:
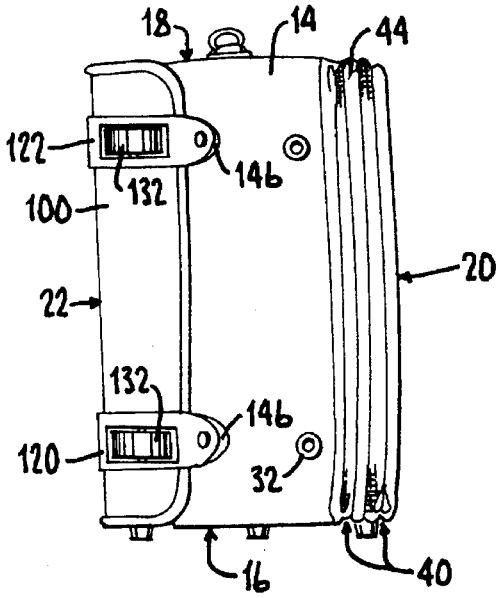
FIG. 8 is a rear elevation view of the suitcase.

The case can be handled or manipulated in a number of orientations. As shown in FIG. 2, the case can be rested on rear wall 14 and carried via handle 36. The case likewise can be rested on side wall 16 and carried via handle 34, as in FIG. 8. For packing and unpacking the case is rested on bottom 22 as in FIG. 1. For wheeling about, the case is placed on rear wall 14, and tilted (forward and to the right in FIG. 2) to be carried on its wheels.

The reinforced sidewall 16 has five protective studs 30, for example of a relatively hard vinyl, riveted thereto. The studs 30 act as feet when the case is placed on a planar support surface and oriented as in FIG. 9, protecting the sidewall 16 from abrasion or wetness when so placed. The rear wall 14 has two studs 32 riveted thereto, which can cooperate as feet with portions of the wheel mounting brackets. A conventional hand grip 34 is riveted to the opposite sidewall 18 and the front wall 12 has a similar hand grip 36 riveted to it, such that the case is readily carried or manipulated in the various orientations.

Figure 3:
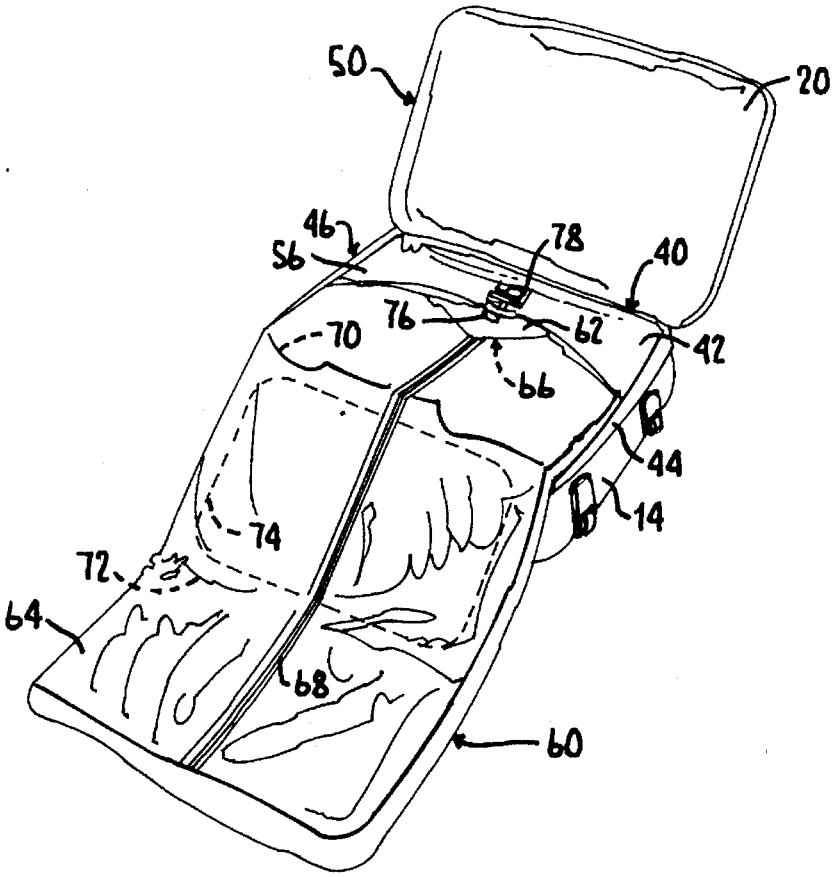
FIG. 3 is a perspective view similar to FIG. 4, except that the top wall flap is shown open and a removable garment bag is shown, foldable upon itself to fit inside a compartment of the suitcase.
Figure 4:
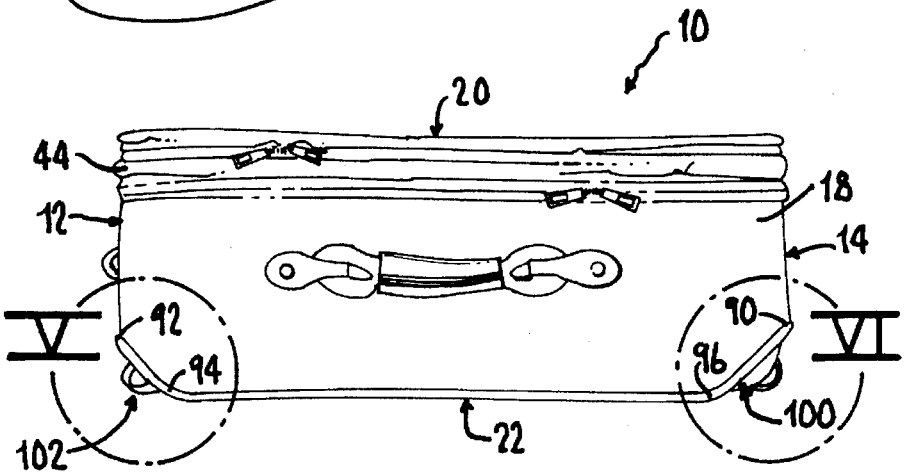
FIG. 4 is a side elevation of the suitcase as viewed from the left front in FIG. 1.
Figure 10:
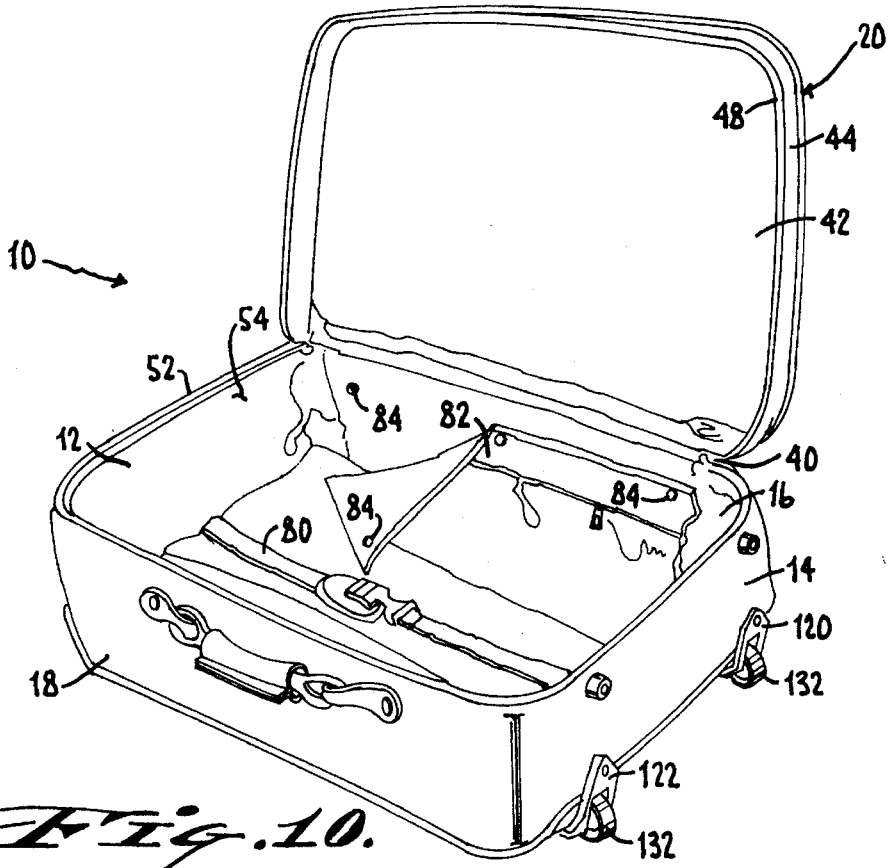
FIG. 10 is a perspective view of the suitcase, similar to the view of FIG. 1 except that a partition is shown in an open position to reveal the larger article compartment of the case.

The reinforced side wall 16 gives the case 10 form to help prevent the top and bottom walls 20 and 22 from collapsing inwardly. The top wall 20 is connected to the reinforced side wall 16 by a flexible hinge portion 40 (see FIG. 3). In FIG. 10, a partition 42 is connected to the reinforced side wall 16 along the same flexible hinge portion 40 to which the top wall 20 is connected (see, e.g., FIGS. 7 and 8). The partition 42 (FIG. 10) has a range portion 44 joined to its periphery, and the flange portion 44 has opposite free edges 46 (FIG. 3) and 48 (FIG. 10). In FIG. 3, the free edge 46 of the flange portion 44 adjacent the top wall 20 is provided with a slide fastener element such as a zipper and the top wall 20 has a mating slide fastener element 50 around its free edges for closing the top wall 20 to the flange portion 44 and zipping up the top wall 20 and flange portion 44 to close the case.

In FIG. 10, the free edge 48 of the flange portion 44 adjacent the three walls of the front, rear and opposite side walls 12, 14 and 18 is also provided with a fastener element, such as a slide fastener, e.g., a zipper. The front, rear and opposite side walls 12, 14 and 18 have free edges provided with one slide fastener element 52 for coupling with the slide fastener element 48 to releasably join the partition 42 with the case 10. The partition 42 and bottom wall 22 define a larger article compartment 54, while the partition 42 and top wall 20 define a smaller article compartment 56.

In FIG. 3, a full length garment bag 60 has a back wall 62 and a front wall 64 generally joined to the back wall 62 along its edges except at the top where a hanger-receiving opening 66 is defined. The front wall 64 is vertically divided into two sections at its center and is adapted to be releasably closed by a slide fastener 68. The garment bag 60 can be made from vinyl plastic, fabric or any other suitable material. The garment bag 60 is sized for holding garments like suits and dresses, e.g., on conventional coated-wire garment hangers, the hooks of which extend through the top opening 66. Such garments can be enclosed in the garment bag 60 when suspended from a conventional closet rod or the like in a generally unfolded condition.

The smaller article compartment 56 is sized for removably receiving the garment bag 60. The garment bag enclosing the garments is preferably folded twice upon itself to fit compartment 56. The two folds define creases 70 and 72, and when folded in a Z-shape the creases 70 and 72 divide the garment bag 60 in three even sections. To facilitate the folding of the garment bag 60 in three evenly-sized sections, the garment bag 60 can include a rigid frame 74. The rigid frame 74 is a hard vinyl rod element formed in a continuous rectangular hoop. In a preferred embodiment, the garment bag 60 is twenty-one inches wide and forty-one inches long while the frame 74 is about twenty inches wide and fourteen inches long. The frame 74 is centrally disposed on the back wall 62 of the garment bag 60.

When folded twice upon itself, the garment bag 60 fits snugly in the smaller article compartment 56. The rigid frame 74 facilitates the close fit between garment bag 60 and the smaller article compartment 56 by urging the four corners of the folded garment bag 60 into the corresponding four corners of the smaller article compartment 56, providing a relatively flat and compact means for holding the garments in the case. The folded garment bag 60 also can be retained positively in the smaller article compartment 56, for example by snap fasteners 76 or hold-down straps (not shown). The partition 42 supports an eyelet 78 for receiving one or more hooks of garment hangers that may extend out of the hanger-receiving opening 66 of the garment bag 60. Similar straps, eyelets and/or fasteners can be placed in the larger article compartment 54 as well, as shown in FIG. 10.

In FIG. 10, the larger article compartment 54 includes hold down straps 80 for retaining folded garments. A toiletries bag 82 is removably attached to the reinforced side wall 16 by means of cooperating snap fasteners 84. The toiletries bag 82 has a zippered opening to prevent toiletries or other articles packed therein from spilling out.

According to the invention, the wheels on which the case can be transported, and the graspable part of the extendable handle, when retracted, are disposed at inclined areas at the edges at the corners where the bottom meets the front and rear walls of the case. In this manner, the wheels and stowed handle part reside at or inside a rectangular box defined by the extension of the planes of the bottom, front and rear walls. In FIG. 1, the rear wall 14 has a bottom edge 90, as in FIG. 2 the from wall 12 has a corresponding bottom edge 92. In FIG. 2, the bottom wall 22 extends in the front to rear direction between a front and rear edge 94 and 96. In FIG. 1, an inclined rear panel 100 extends between the rear edge 96 of the bottom wall and bottom edge 90 of the rear wall 14. In FIG. 2, an inclined front panel 102 extends between the bottom edge 92 of the front wall 12 and the front edge 94 of the bottom wall 22. The inclined panels 100 and 102 also are shown in FIGS. 4 through 9.

As shown in FIG. 2, a continuous bead 104 extends in the front to back direction along the lateral edges of the bottom wall 22 and inclined panels 100 and 102, and in the lateral direction along the bottom edges 92 and 90 of the front and rear walls 12 and 14, for example being sewn into the seams. The suitcase 10 has an extensible handle 106 shown in an extreme extended position in FIG. 2, and as retracted or stowed in FIGS. 4 and 9. The handle 106 has an inverted-U shape defined by a gripping portion 108 extending between opposite elongated rods or arms 110 and 112. The handle 106 is movable through a range of position between the extreme retracted position and the extreme extended position, and the user may wish to roll the case along with the handle fully extended or only partially extended. Detent means (not shown) can be provided to frictionally fix the handle at defined positions, or the handle can be held frictionally at any length of extension.

Figure 9:
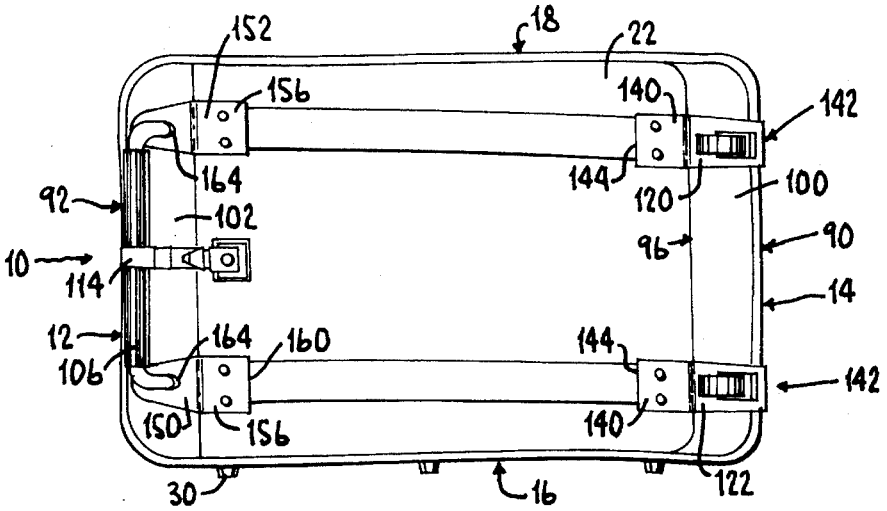
FIG. 9 is a bottom plan view of the suitcase.

In FIG. 9, the handle 106 is shown releasably secured in the retracted position by a strap loop 114 with releasably connectable fastening elements 116 at the loop ends. In FIG. 2, the strap loop 114 is shown opened and disengaged from the handle. The handle 106 can be formed from tubular steel or the like, and the gripping portion 108 can be fitted with a graspable sleeve made of leather, vinyl plastic or the like.

Figure 6:
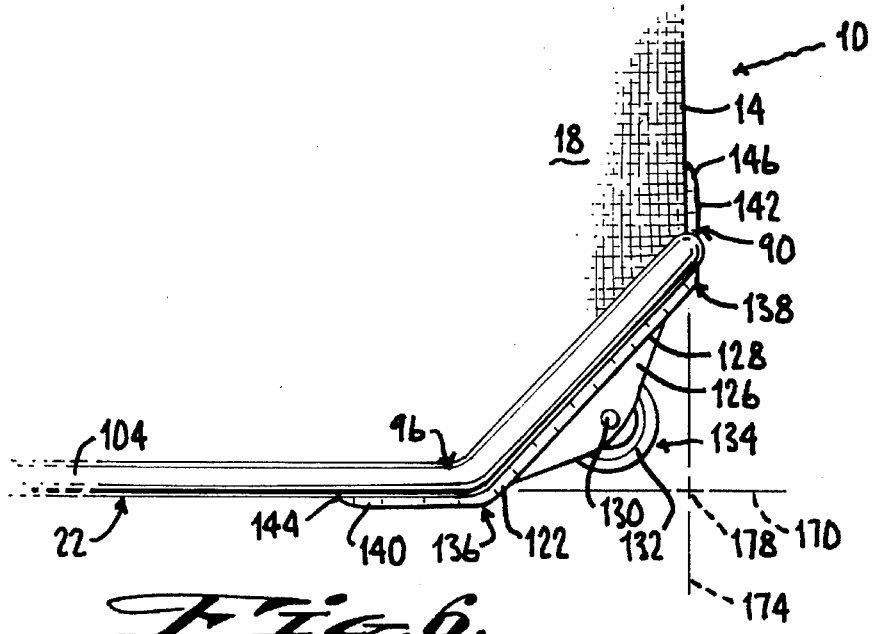
FIG. 6 is an enlarged elevation view of the detail encircled by line VI of FIG. 4.

With reference to FIGS. 1 and 6, a pair of wheel-carrying brackets 120 and 122 are mounted at laterally spaced positions on the inclined rear panel 100. Each bracket 120 and 122 includes a pair of flanges 124 and 126 projecting out from a central base portion 128 (FIG. 6). The projecting flanges 124 and 126 are spaced to define a wheel well. A pivot pin 130 (FIG. 6) is mounted to extend between the flanges for rotatably carrying a wheel 132. The outer perimeters 134 of the wheels engage the ground or other supporting surface when the case is tilted toward the handle 106, or to the right in FIG. 6.

The base portion 128 of the wheel brackets has spaced junctions 136 and 138 to which the base portion 128 is joined to a pair of outer flange portions 140 and 142. The base portion 128 extends across the rear inclined panel 100 such that the junctions 136 and 138 align with the rear edge 96 of the bottom wall 22 and bottom edge 90 of the rear wall 14 respectively. The forward outer flange portion 140 terminates in a forward straight edge 144 (see also FIG. 9), while a rearward outer flange 142 portion terminates in a semi-circular edge 146 (see also FIG. 8). These edges 144, 146 can be high enough to cooperate with one or more feet 32 (see FIG. 1) for supporting the case such that the walls 14 or 22 are disposed at a slight space from the ground, e.g., with the feet 32 and edges 144, 146 being of substantially equal height.

The brackets 120 and 122 are shaped to conform to the contour of the case 10 such that the outer flange portions 140 and 142 extend partly onto the bottom and rear walls 22 and 14 respectively while the base portion 128 extends across the inclined rear panel 100, as shown. The brackets 120 and 122 are mounted by means of a plurality of fasteners through the outer flange portions 140 and 142. The outer flange 142 portion, that extends partly across the rear wall 14, therefore not only can serve as a toot, but also supports, shapes and protects the case.

Figure 5:
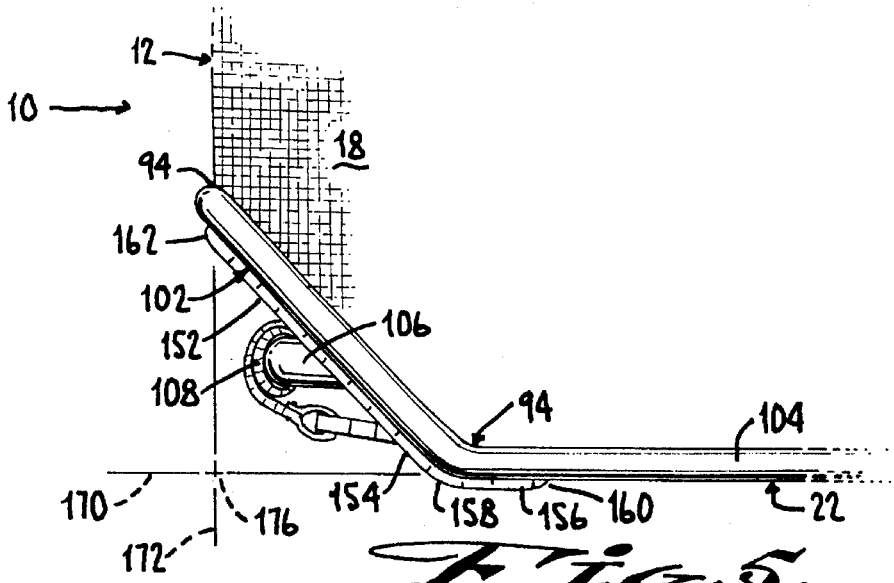
FIG. 5 is an enlarged elevation view of the detail shown encircled by line V of FIG. 4.
Figure 7:
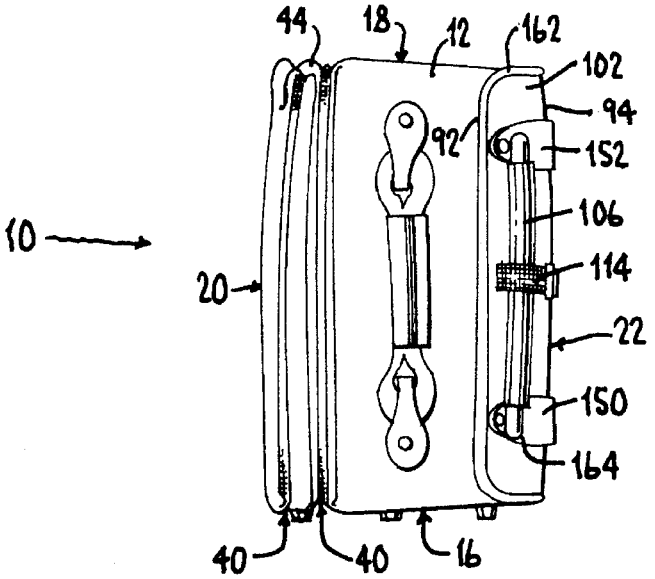
FIG. 7 is a front elevation view of the suitcase.

Referring to FIGS. 2 and 5, the case 10 has a pair of arm or rod receiving sockets 150 and 152 mounted at laterally spaced positions on the inclined front panel 102. Each socket 150 and 152 includes a base portion 154 joined to a distal flange portion 156 at a junction 158 (see FIG. 5). In FIG. 5, the distal flange portion 156 terminates in a rearward straight edge 160 (see also FIG. 9) while the base portion 154 extends from the junction 158 to taper to a semi-cylindrical edge 162 (see also FIG. 7). The sockets 150 and 152 are shaped to conform to the contour of the case 10 such that the base portion 154 extends generally across the inclined front panel 102 as the distal flange portion 156 extends partly across the bottom wall 22. The junction 158 is aligned with the front edge 94 of the bottom wall 22. The sockets 150 and 152 are fastened to the case 10 by fasteners through the distal flange portion 156. The sockets 150 and 152 define arm-receiving openings 164 (FIGS. 7 and 9). The openings 164 are oriented so that the handle 106 can extend and retract linearly in the front to rear direction.

A pair of wear strips 166 and 168 extend parallel to one another across the bottom wall 22 in the front to back direction as shown in FIGS. 2 and 9. The wear strips 166 and 168 can be made of extruded vinyl or the like and are sewn, riveted or similarly affixed in place to the bottom wall 22. The wear strips 166 and 168 protect the surface of the bottom wall of case 10, for example made of a fabric or the like, when the user encounters a staircase or other vertical displacement over which the case is to be transported. The wear strips 166 and 168 engage the front edge of the stairs or other obstacle so that the case 10 may be dragged up and over the front edge until the wheels pass over the edge. The wear strips 166 and 168 bear the frictional contact with the obstacle over which the case 10 is being hauled, and generally help to support and protect the case.

When the bag is laid down as in FIGS. 1, 5 and 6, the bottom wall 22 generally defines a horizontal plane, designated as 170 in FIGS. 5 and 6. The front wall 12 generally defines a vertical plane 172 and the rear wall defines plane 174. The continuations of these planes beyond the inclined corner sections of the wheels would intersect at imaginary corners 176, 178. The handle 106, and more particularly the gripping portion 108 of the handle, preferably retracts in the extreme retracted position to the extent that the handle 106 is spaced inwardly from the planes 170 and 172. Similarly, the ground-engaging perimeters 134 of the wheels 132 are spaced inwardly the planes 170 and 174. Whereas the retracted handle and the wheels do not protrude beyond the planes 170, 172 and 174, the handle and wheels do not form protrusions from a rectilinear outside contour in the shape of a box. When the case is laid against a flat surface as in FIGS. 5 or 6, such as on the ground, in a storage compartment or against another case, the case resides on the respective plane.

With regards to the wheels 132, the wheels 132 are positioned relative to the rear and bottom walls 14 and 22 such that the wheels 132 are held out of contact with vertical and horizontal surfaces. As the case 10 is slid on the bottom wall 22, for example, the bottom wall supports the wheels above the surface and the rear wall 14 acts as a bumper for obstacles extending up from the surface in the path of the sliding case 10. The outer flange portions 140 and 142 cooperate in the same way, acting as relatively harder bumpers or fenders.

Nevertheless, the perimeters 134 of the wheels 132 readily engage a flat support surface (e.g., the ground) when the suitcase 10 is tilted such that the rear and bottom walls 14 and 22 are inclined relative to the support surface. When tilted around the wheel area (to the right in FIG. 6 or up in FIG. 5), the case 10 is ready for wheeled transportation across the planar surface, being pulled, pushed, steered or negotiated by a user via the handle 106, preferably extended as in FIG. 2.

The handle 106 in the retracted position (FIG. 5) is similarly protected from abuse while the bottom wall 22 is slid along a planar support surface. The front wall 12 then acts as a bumper for vertical obstacles and the flange portions 156 of the sockets 150 and 152 cooperate with the forward flange portions 140 of the brackets 120 and 122 to act as skids or feet. When the bottom wall 22 is slid across a planar support surface, the wear strips 166 and 168 provide additional protection for the bottom wall 22, and support for the shape of the case.

The inward spacing of the wheels 132 and handle 106 also protects the wheels 132 and handle 106 from snagging against obstructions and from damage in situations other than when sliding the suitcase 10 over a planar support surface. The mounting of the wheels and handle are also protective generally, for example, when the suitcase 10 being manipulated into an overhead compartment of an airplane, into a car trunk, etc.

The foregoing arrangement of the extendable handle and wheels provides a form of structural framework associated with the bottom wall 22 of the case. Access flaps 20 and 42 thus are arranged at the top of the suitcase 10 rather than at the bottom. The bottom wall 22 of the suitcase 10 provides a mounting surface for the brackets 120 and 122, sockets 150 and 152, and wear strips 166 and 168. The top wall 20 is arranged for access to the interior. To obtain two independently accessible article compartments 54 and 56, the partition 42 has been hinged to the reinforced side wall 16 and provided with flange portion 44, fitted with opposite slide fastener elements 46 and 48.

Thus, although the bottom wall is employed for the handle and wheel transport features, the suitcase 10 nevertheless is provided with two article compartments 54 and 56, divided from the interior volume by partition 42, and independently available for access via the slide fasteners.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. A suitcase comprising:

a case body including an outer bottom wall with front and rear edges and generally defining a bottom plane, outer front and rear walls with bottom edges generally defining front and rear planes substantially perpendicular to the bottom plane, and side and top walls respectively joined to one another and to the bottom, front and rear walls to form a container having top and bottom walls of greater area than the side walls, and side walls of greater area than the front and rear walls, a closure being provided around the front and rear walls and one of the side walls;

an elongated handle, coupled to the suitcase to move between extended and retracted positions, the handle providing a gripping portion;

handle receiving means defining at least one opening for movably receiving the handle whereby the handle can be retracted and advanced along the bottom wall to move the gripping portion toward and away from the front wall;

two inclined panels, each being joined to and extending between the bottom wall and one of the front and rear walls;

at least one wheel and wheel-mounting means for rotatably carrying the wheel at the inclined panel between the front and bottom walls;

wherein the handle and the wheel are each mounted at a respective one of the inclined panels such that the gripping portion when the handle is retracted and the wheel for every given position of the wheel is disposed inwardly from an intersection of the bottom plane and a respective one of the front and rear planes.

2. The suitcase of claim 1, wherein the top and bottom walls are substantially 16 by 22 inches (41 by 56 cm); the side walls are substantially 9 by 22 inches (23 by 56 cm); and the front and rear walls are substantially 16 by 9 inches (41 by 23 cm).

3. The suitcase of claim 1, wherein:

the handle-receiving means extends along an inside of the bottom wall and comprises a pair of sockets which have flange portions attached to said walls of the suitcase.

4. The suitcase of claim 3, wherein:

each socket comprises a pair of flange portions, one of which is a base portion and the other of which is a distal flange portion, joined together at a junction aligned with a junction between the front edge of the bottom wall and the front inclined panel, such that when the handle is retracted the gripping portion of the handle is exposed on an outside of the inclined panel between the front and bottom walls;

wherein the base portion extends substantially across the front inclined panel between the bottom edge of the front wall and the front edge of the bottom wall; and, the distal flange portion extends from the junction with the base portion, partly across the bottom wall, terminating in a rearward edge.

5. The suitcase of claim 1, wherein:

the wheel-mounting means includes a bracket having flange portions attached to said walls of the suitcase.

6. The suitcase of claim 5, wherein:

the bracket includes a pair of spaced flanges defining a wheel well therebetween and supporting a pin for rotational mounting of the wheel.

7. The suitcase of claim 6, wherein:

the bracket has three flange portions, the three flange portions comprising a central base portion extending between a pair of outer flange portions for supporting at least two spaced wheels;

wherein one of the outer flange portions extends partly across the bottom wall from a junction of the bottom wall and the base portion, said junction being aligned with a junction between the rear inclined panel and the rear edge of the bottom wall;

the other of the outer flange portions extending partly across the rear wall from a junction with the base portion, which junction between the base and other flange portion is aligned with a junction between the rear inclined panel and the bottom edge of the rear wall; and, the base portion extends across the rear inclined panel for rigidly supporting the at least two spaced wheels.

8. A suitcase comprising:

a generally rectangular container that includes an outer bottom wall having spaced front and rear edges, and outer front and rear walls of which each has a bottom edge;

access means in said container for providing access to an interior of the container;

a U-shaped handle, coupled to the suitcase to move between extended and retracted positions, having a gripping portion extending between elongate arms defining a U-shape;

handle-receiving means defining openings movably receiving the elongate arms, permitting the arms to extend and retract in a front to rear direction between the extended and retracted positions;

a pair of wheels and wheel-carrying means for rotatably supporting the wheels at spaced positions, the wheels being mounted on fixed axes and having outer perimeters;

a rear inclined panel joined to and extending between the rear edge of the bottom wall and the bottom edge of the rear wall, providing a mounting surface for the wheel-carrying means such that the perimeters of the wheels, for every given position of the wheels, are spaced inwardly from intersecting planes defined by the bottom and rear walls respectively.

9. The suitcase of claim 8, further comprising a partition dividing said container into two compartments, the suitcase including an outer top wall parallel to said bottom wall, said partition generally being parallel to said top and bottom walls.

10. The suitcase of claim 9, wherein:

said access means comprises flexible flaps, one of the flaps forming a portion of the partition and the other forming at least a portion of the top wall, and fasteners releasably connecting the flaps in closed positions.

11. The suitcase of claim 9, wherein:

said partition divides said container into a larger article compartment and a smaller article compartment; and, said smaller article compartment is sized for removably receiving a folded garment bag.

* * * * *